166-274 SR
9/30/80 XR 4,224,989

United States Patent [19]
Blount

[11] 4,224,989
[45] Sep. 30, 1980

[54] METHOD OF DYNAMICALLY KILLING A WELL BLOWOUT

[75] Inventor: Elmo M. Blount, Irving, Tex.

[73] Assignee: Mobil Oil Corporation, New York, N.Y.

[21] Appl. No.: 955,738

[22] Filed: Oct. 30, 1978

[51] Int. Cl.[2] ..... E21B 35/00; E21B 47/06
[52] U.S. Cl. ..... 166/250; 166/271; 166/274; 169/69; 175/61
[58] Field of Search ..... 166/250, 268, 271, 273, 166/274, 281, 285; 169/45, 46, 69; 175/61, 62

[56] References Cited

U.S. PATENT DOCUMENTS

| | | | |
|---|---|---|---|
| 1,879,160 | 9/1932 | Fowzer | 169/46 |
| 3,003,557 | 10/1961 | Huitt et al. | 166/271 |
| 3,282,355 | 11/1966 | Henderson | 175/61 |
| 3,285,350 | 11/1966 | Henderson | 175/62 X |
| 3,313,361 | 4/1967 | McCullough | 169/69 X |
| 4,133,383 | 1/1979 | Ely | 166/285 |

OTHER PUBLICATIONS

Lewis, "The Use of the Computer and Other Special Tools for Monitoring a Gas Well Blowout During the Kill Operation–Offshore Louisiana", SPE 6836, 1977.
Barnett, "A Logical Approach to Killing an Offshore Blowout, West Cameron 165 Well No. 3–Offshore Louisiana," SPE 6903, 1977.
Bruist,"A New Approach in Relief Well Drilling", *Journal of Petroleum Technology*, Jun. 1972, pp. 713–722.
Miller et al., "Reservoir Engineering Techniques Used to Predict Blowout Control During the Bay Marchand Fire", Journal of Petroleum Technology, Mar. 1972.

*Primary Examiner*—Stephen J. Novosad
*Assistant Examiner*—George A. Suchfield
*Attorney, Agent, or Firm*—C. A. Huggett; William D. Jackson

[57] ABSTRACT

A process for dynamically killing a well blowout by means of a relief well. A low density fluid is pumped down the relief well and into the blowout well at a rate to produce a frictional pressure loss in the blowout well which when added to the hydrostatic pressure in the blowout well is greater than the static formation pressure but less than the formation fracturing pressure. Injection of the low density fluid is continued until the blowout well goes from two-phase to single-phase flow. Thereafter, a high density fluid such as a drilling mud is pumped down the relief well and into the blowout well. This fluid produces a hydrostatic pressure in the blowout well which is greater than the static formation pressure.

3 Claims, 1 Drawing Figure

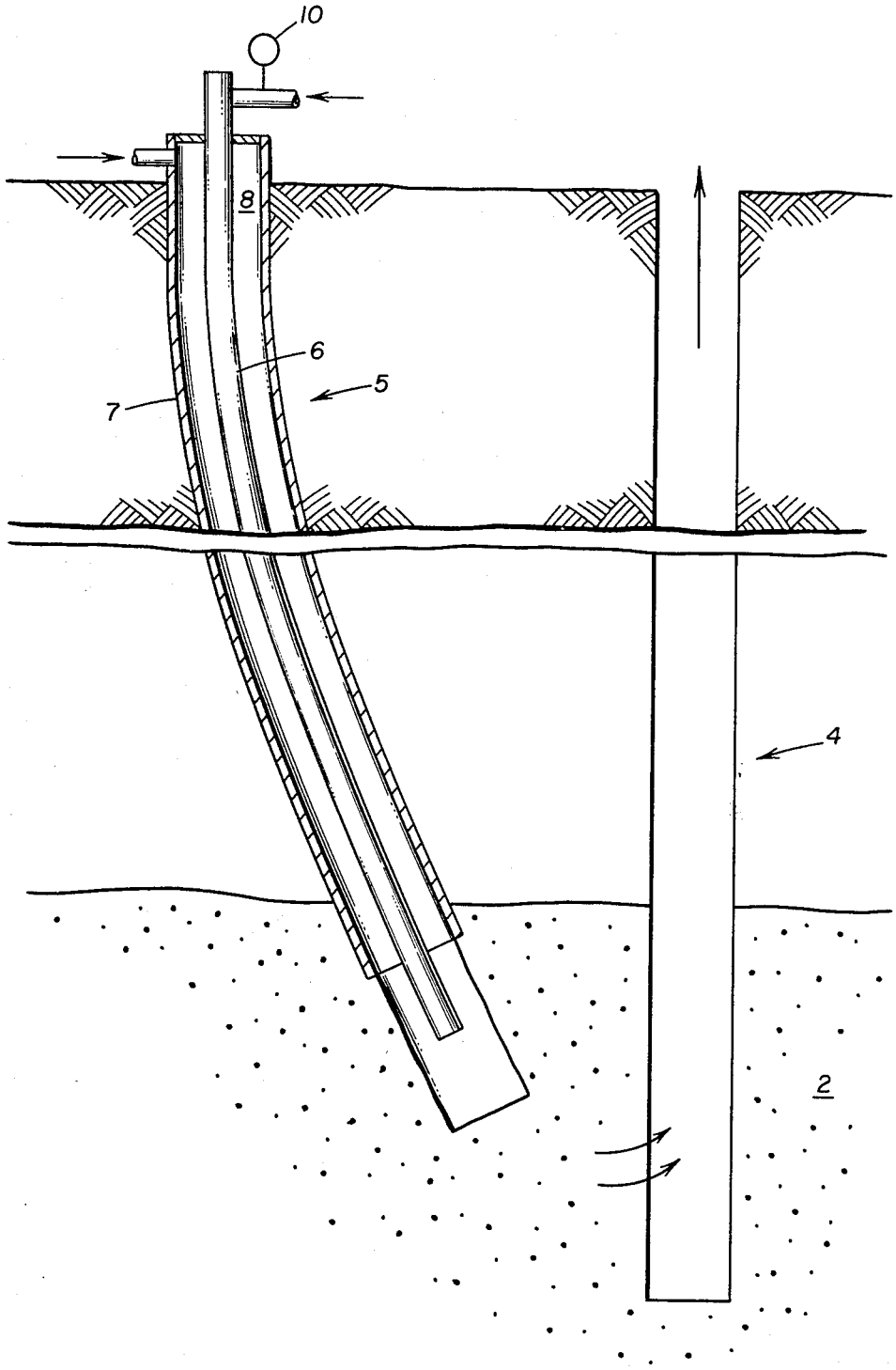
10
8
6
5
7
4
2

METHOD OF DYNAMICALLY KILLING A WELL BLOWOUT

BACKGROUND OF THE INVENTION

The present invention relates to the control of well blowouts and more particularly to a method for dynamically killing a well blowout.

Typically, wells are drilled into the earth's crust to desired subterranean locations, e.g. oil- and/or gas-bearing formations, through the application of rotary drilling techniques. In the rotary drilling of a well, a drilling mud is pumped downwardly through a rotating drill string within the well, through the drill bit at the bottom of the drill string, and thence upwardly to the surface of the well through the annulus surrounding the drill string. A "blowout" may occur when the well penetrates a high pressure gas-producing formation due to a number of circumstances. Thus, gas from a high pressure formation may enter the well and mix with the drilling mud so that its density is reduced by gas occlusion, thus reducing the hydrostatic head on the well to a value less than that of the formation pressure. A blowout may also occur during removal of the drill string from the well. Displacement of the drilling mud by the drill string may result in a decrease in the liquid level within the well with, again, a decrease in the hydrostatic head at the level of the high pressure formation.

When a blowout occurs, a number of remedial procedures are available to kill the blowout and bring the well under control. One technique involves the drilling of a relief well into a subterranean location near the blowout well. Communication between the relief well and blowout well is established and fluids then pumped down the relief well and into the blowout well in an attempt to impose a sufficient hydrostatic head to block the flow of gas from the formation into the well. Communication between the wells may be established through the high pressure sand which caused the blowout or through a separate permeable zone penetrated by both the blowout and relief wells. The formation may be acidized in order to increase the fluid conductivity between the wells. Fracturing may also be employed although in most cases this is undesirable since most fractures tend to be naturally oriented in a generally vertical direction. This is particularly true in formations at depths of about 3000 feet and more since at these depths the overburden pressure will usually exceed the horizontal stress characteristics of the formation.

SUMMARY OF THE INVENTION

In accordance with the present invention, there is provided a new and improved technique for killing a blowout by the injection of fluid through a relief well. In carrying out the invention, the fluid employed during the initial portion of the kill procedure is a low density fluid which produces a hydrostatic pressure component which is less than the static pressure of the formation. The low density fluid is pumped down the relief well and into the blowout well at a rate to produce a frictional pressure component in the blowout well which, when added to the hydrostatic pressure component, is greater than the static formation pressure but less than the formation fracturing pressure. The injection of the low density fluid is continued at progressively increasing rates until a sufficient flow rate up the blowout well is achieved to block the flow of gas from the high pressure formation causing the blowout. Thereafter, a high density fluid is introduced into the relief well which produces a hydrostatic pressure component which is greater than the static formation pressure. This high density fluid is pumped down the relief well and into the blowout well at a flow rate less than the maximum flow rate of the low density fluid. The sum of the frictional pressure component and the hydrostatic pressure component is less than the formation fracturing pressure.

BRIEF DESCRIPTION OF THE DRAWING

The drawing is a schematic illustration of a blowout well and a relief well employed in carrying out the present invention.

DESCRIPTION OF THE SPECIFIC EMBODIMENTS

As noted previously, it is a conventional practice to pump fluid down a relief well into a blowout well in order to kill the blowout and bring the well under control. As the kill fluid enters the blowout well, a two-phase (gas and liquid) flow condition is produced. Once the well is killed, i.e. the formation quits producing gas into the well, the wellbore goes rapidly to a single-phase flow condition. If a relatively high density drilling mud, e.g. a mud having a density such that its equivalent weight is sufficient to balance the static formation pressure, the bottomhole pressure would rise rapidly when the wellbore goes from two-phase to single-phase flow. Unless steps are taken to immediately reduce the pumping rate at the relief well when the blowout well goes into single-phase flow, the increase in bottomhole pressure would ultimately rise to a value above the formation fracturing pressure. Fracturing of the formation would, of course, result in the loss of liquid from the wellbore and the well would again blowout.

The present invention involves the use of a dynamic kill technique in which the blowout is initially killed through the use of a fluid having a density which is less than the equivalent weight of fluid required to balance the static formation pressure. Preferably, the fluid has a density no greater than two-thirds of the equivalent weight of fluid required to balance the static formation pressure. As this initial fluid is pumped down the relief well and into the blowout well, a two-phase flow condition is produced. As the relief well pumping rate is progressively increased, the flow rate through the blowout well similarly increases with an attendant rise in the frictional pressure loss until the sum of the frictional pressure component and the hydrostatic pressure component reaches the formation pressure. At this point, the pressure differential from the formation to the wellbore is eliminated and the wellbore goes into single-phase flow. As the transition is made from the two-phase to single-phase flow, the hydrostatic pressure component is increased and the frictional pressure component is decreased. For a fluid having a density equal to two-thirds of that required to balance the static formation pressure, these components change by approximately the same amounts. At this point, the well is theoretically "dead" but the dynamic kill fluid must still be injected at a sufficient rate such that the sum of the hydrostatic pressure component and the frictional pressure component in the blowout well still exceeds the static formation pressure.

Once the dynamic flow condition is reached, the well may then be shifted to a static kill condition by the injection of a fluid such as drilling mud which has a sufficiently high density to produce a hydrostatic pressure greater than the static formation pressure. The high density fluid is pumped into the relief well at a rate which is less than the maximum pumping rate of the dynamic kill fluid to produce a frictional pressure loss in the blowout well which when added to the hydrostatic pressure component is less than the formation fracturing pressure. Preferably, the density of the drilling mud is increased in at least two increments, as explained hereinafter, while progressively decreasing the pumping rate until an essentially static condition is reached.

Turning now to the drawing, there is illustrated a subterranean formation 2 which is penetrated by a well 4 which is blown out and a well 5 drilled as a relief well. While for the purpose of describing the invention only one relief well is shown, it will be recognized that two or more relief wells may be employed as described hereinafter. The term "formation" is not used herein in a lithologic sense but rather to denote a subterranean rock structure open to communication, either directly or indirectly, to the blowout and relief wells. Thus, the relief well may penetrate into the high pressure gas zone causing the blowout and communication between the wells established through this zone or communication between the wells may be established through a separate permeable zone. For example, the blowout well may penetrate and be encased in two distinct rock zones separated by an impermeable shale barrier, one being a zone of relatively low pressure and the other a zone of high pressure sand causing the blowout. In this case, the relief well may be completed only in the low pressure zone and be in direct communication with the blowout well through the low pressure zone and in indirect communication with the high pressure zone through the blowout well. As illustrated in the drawing, the relief well preferably is equipped with a tubing string 6 and a well casing 7 which define an annulus 8 through which the kill fluids are injected. The tubing wellhead is provided with a pressure measuring means 10 which is employed to monitor the downhole pressure of the relief well as described hereinafter.

In killing the well with the dynamic kill fluid, the bottomhole pressure in the relief well must, of course, be greater than the bottomhole pressure of the blowout well in order to accommodate the frictional pressure loss of flow from the relief well to the blowout well. The bottomhole pressure of the relief well is equal to the sum of the wellhead pressure and the hydrostatic pressure minus the frictional pressure loss. The bottomhole pressure in the blowout well is equal to the sum of the hydrostatic pressure and the frictional pressure loss, it being assumed that the wellhead pressure of the blowout well is zero since the well is uncontrolled. Once a single-phase flow condition in the blowout well is reached, the hydrostatic pressure components in the blowout and relief wells are substantially the same and thus the wellhead pressure on the relief well is equal to the sum of the frictional pressure components in the relief well, blowout well, and in the formation providing communication between the relief and blowout wells. These relationships may be expressed by the following equations:

$$BHP_b = BHP_r - FP_c \quad (1)$$

$$BHP_b = HP_b + FP_b \quad (2)$$

$$BHP_r = WHP_r HP_r - FP_r \quad (3)$$

$$WHP_r = FP_r + FP_b + FP_c \quad (4)$$

wherein:

WHP is the wellhead pressure,
HP is the hydrostatic pressure,
FP is the frictional pressure loss,
BHP is the bottomhole pressure, and the subscripts r, b, and c denote the relief well, the blowout well, and the communication between these wells, respectively.

The frictional pressure components may be calculated by any suitable means as will be understood by those skilled in the art. In the case of annular flow, the frictional pressure loss, FP, in pounds per square inch, may be defined by the following equation:

$$FP = (11.41 f L \rho Q^2)/d_e^5 \quad (5)$$

wherein:

f is the fanning friction factor,
L is the measured depth of the well in feet,
$\rho$ is the density of the fluid in pounds per gallon,
Q is the flow rate in barrels per minute, and
$d_e$ is the equivalent diameter in inches.

During the dynamic kill operation, the low density fluid is pumped down the relief well annulus at a sufficiently high rate to produce a bottomhole pressure in the well greater than the sum of the formation pressure and the frictional pressure loss in flow from the relief well to the blowout well. Thus, the low density fluid enters the blowout well at a pressure greater than the formation pressure. At the same time a fluid is pumped down the tubing string at a low rate to provide a substantially constant pressure differential from the wellhead to the bottom of the tubing string. That is, the fluid is pumped down the tubing string at a rate just sufficient to maintain fluid in the tubing string with negligible friction losses so that the pressure differential from the wellhead to the bottom is equal to the hydrostatic head. Thus the wellhead pressure at the tubing string may be measured and added to the calculated hydrostatic pressure in the tubing string to continuously monitor the bottomhole pressure in the relief well. The tubing string fluid may be the same as or different than the dynamic kill fluid, but in any event has density such that its hydrostatic head is less than the static formation pressure. The pumping rate down the relief well annulus is progressively increased with fluid flowing from the relief well into and up the blowout well under turbulent flow conditions until the sum of the hydrostatic pressure component and the frictional pressure component in the blowout well exceeds the pressure at which gas enters the blowout well from the formation. Ultimately this blocks the flow of gas into the blowout well and the well begins to transition from two-phase flow to single-phase flow. During this procedure, the bottomhole pressure in the relief well is monitored to ensure that it does not reach the fracturing pressure of the formation. Once the steady-state flow condition is produced in the blowout well, the transition to a higher density fluid can begin. Preferably, the density of the fluid injected into the relief well annulus is progressively increased in at least two increments to the final fluid density desired for a static kill condition.

If the relief well capacity is not sufficient to produce a steady-state flow condition in the blowout well, one or more additional relief wells can be provided. Each relief well, of course, is operated in accordance with the aforementioned procedure in which the dynamic kill fluid is pumped down the relief well at a wellhead pressure which produces a bottomhole pressure greater than the formation pressure and less than that of the formation fracturing pressure.

A specific example of the present invention is provided by the following procedure employed to dynamically kill a blowout in a well cased with 8.535-inch I.D. casing and having 5-inch O.D. drill pipe in the hole. The measured total depth of the well was 10,210 feet and the well was blown out in a high pressure gas zone at a vertical depth of 9,650 feet. Reservoir engineering studies indicated that the gas zone had a static formation pressure, i.e. the pressure of the formation in the vicinity of the well before the blowout, of 7100 psig. The formation fracturing pressure was estimated to be about 8500 psig.

A directional relief well was drilled in the vicinity of the blowout well to a total measured depth of 10,900 feet (equivalent to a total vertical depth of 9,560 feet). The well was cased with 8.535-inch I.D. casing and equipped with a 3½-inch O.D. tubing. A directional survey indicated the relief well was about 27 feet from the blowout well at total depth.

In the dynamic kill procedure, fresh water was employed as the dynamic kill liquid. The water had a density of 8.33 pounds per gallon, equivalent to an incremental hydrostatic head of 0.433 psi per foot. Preliminarily to initiating the kill attempt, the drilling mud in the relief well was reversed out by pumping water down the annulus with mud returns through the tubing. Once the mud was completely displaced from the well, an acidizing procedure was started in order to increase the communication between the relief well and the blowout well. The acidizing procedure was carried out employing 15 percent hydrochloric acid which was pumped down the tubing at a flow rate of about 4 barrels per minute. After injecting acid at this rate for about 40 minutes, the pump rate was reduced to about 3 barrels per minute and shortly thereafter the wellhead pressure at the annulus decreased by 350 psi, indicating that communication from the relief well to the blowout well was established. After pumping additional acid, the dynamic kill procedure was started by increasing the pumping rate down the annulus from an initial value of about 4.3 barrels per minute at a wellhead pressure of 2010 psig to a final value of 125 barrels per minute at a wellhead pressure of 5840 psig. Tubing injection was switched from acid to water and when the pumping rate down the annulus reached about 35 barrels per minute, the rate down the tubing was reduced from 4 barrels per minute to 1 barrel per minute and remained constant at that value throughout the kill procedure. This established a substantially constant hydrostatic head in the tubing and during the kill procedure the tubing wellhead pressure was measured in order to monitor the bottomhole pressure. About 34 minutes after the start of the kill procedure, when the pumping rate down the annulus was at 85 barrels per minute, the wellhead fire at the blowout was reported to be essentially out. Thereafter, the pumping rate was increased to 125 barrels per minute and maintained at this value for about 15 minutes and then decreased to about 80 barrels per minute at a wellhead pressure of 3290 psig. During this interval, the blowout well re-ignited.

The total volume of water pumped down the annulus of the relief well during the dynamic kill procedure was 5220 barrels. At the conclusion of this, the transition to an intermediate 14.5 pounds per gallon drilling mud was started with an initial pumping rate of 73 barrels per minute at an annulus wellhead pressure of 3460 psig. The pumping rate for the intermediate mud was stabilized at 83 barrels per minute for a period of about 8 minutes during which the mud started to enter the blowout well. Thereafter, the pumping rate down the annulus was progressively decreased to a value of about 49 barrels per minute and, after the injection of 1525 barrels of intermediate mud, the transition to a heavier 16.5 pounds per gallon mud was started. This heavier drilling mud was pumped down the annulus of the relief well at an initial rate of 49 barrels per minute and thereafter reduced to about 15 barrels per minute until sufficient mud was injected to fill the annuli of the relief and blowout wells. Thereafter the pumping rate of the 16.5 PPG mud was reduced with variations to an ultimate rate of about 1½ barrels per minute.

The chronology of the dynamic kill procedure is set forth in Table I in which the first column sets forth elapsed time, the third and fourth columns set forth the pumping rate and wellhead pressure for the tubing string, and the fifth and sixth columns set forth the pumping rate and wellhead pressure for the relief well annulus.

TABLE I

| | | Tubing | | Annulus | |
|---|---|---|---|---|---|
| Time, hours | Remarks | Rate BPM | Press Psig | Rate BPM | Press Psig |
| 0:00 | Began pumping water down annulus. Continue pump acid down tubing. | 4 | 2270 | 4.3 | 2010 |
| 0:05 | Switched from pumping acid to pumping water down tubing. | 4 | 2280 | 18 | 2070 |
| 0:10 | | 4 | 2280 | 33 | 2260 |
| 0:22 | | 1 | 1970 | 35 | 2310 |
| 0:34 | A total of 1420 bbls of water had been pumped down annulus. The combined annular volumes of relief and blowout wells equal 1138 bbls. Fire was reported to be essentially out at blowout well. | 1 | 2160 | 85 | 4160 |
| 0:45 | Reached peak pumprate down annulus. | 1 | 2410 | 125 | 5840 |
| 0:52 | Start to reduce pump rate from 125 BPM. | 1 | 2440 | 125 | 5880 |
| 1:01 | Blowout re-ignited. | 1 | 2200 | 80 | 3290 |
| 1:12 | Total volume of water pumped down annulus during dynamic kill 5220 bbls. Started pumping intermediate mud (14.5 ppg) down annulus. | 1 | 2250 | 73 | 3460 |
| 1:17 | Rate down annulus stabilized at 83 BPM. | 1 | 2290 | 83 | 2570 |
| 1:20 | Relief well annulus filled completely with 635 bbls of intermediate | 1 | 2330 | 83 | 2090 |

TABLE I-continued

| Time, hours | Remarks | Tubing Rate BPM | Tubing Press Psig | Annulus Rate BPM | Annulus Press Psig |
|---|---|---|---|---|---|
| | mud. Start filling blowout well annulus. | | | | |
| 1:25 | | 1 | 3180 | 83 | 2820 |
| 1:26 | Began steadily reducing pump rate of intermediate mud down annulus. Total volume of intermediate mud was 1140 bbls. Blowout was theoretically killed, when the $BHP_b$ exceeded 7100 psi. | 1 | 3670 | 71 | 2780 |
| 1:33 | Finished pumping intermediate mud; total pumped 1525 bbls. | 1 | 3800 | 49 | 1640 |
| 1:34 | Start pumping 16.5 ppg kill mud down relief well annulus. Throughout the pumping of kill mud, pump rate was gradually decreased. Continued pumping water down tubing. Fire at blowout reported to be out. | 1 | 4040 | 49 | 1870 |
| 1:53 | 675 bbls of kill mud was pumped down annulus and had started flowing up blowout annulus. Annulus pressure had reached minimum, and started to rise hereafter. Continued to decrease annulus pump rate. | 1 | 3350 | 2.8 | 0 |
| 2:08 | | 1 | 3880 | 15 | 200 |
| 2:11 | A total of 1150 bbls of kill mud pumped, completely filling annuli of relief and blowout wells. | 1 | 3980 | 15 | 90 |
| 2:24 | Annulus pump reduced to 5 BPM, and held steady. | 1 | 4190 | 5 | 40 |
| 3:44 | Annulus pump rate increased to 14 BPM, and held steady, because annulus pressure was decreasing to near zero psi. | 1 | 4100 | 14 | 50 |
| 5:22 | Annulus pump rate reduced to 8.5 BPM, and held steady. | 1 | 3990 | 8.5 | 230 |
| 8:33 | Start displacing water in tubing with 16.5 ppg kill mud. Reduce annulus pump rate. | 1.0+ | 3940 | 6.5 | 250 |
| 11:16 | Reduce annulus pumprate. | 1.0± | 280 | 4.5± | 240 |
| 11:43 | Rates maintained | 0.5± | 130 | 1.5± | 240 |

TABLE I-continued

| Time, hours | Remarks | Tubing Rate BPM | Tubing Press Psig | Annulus Rate BPM | Annulus Press Psig |
|---|---|---|---|---|---|
| | thereafter. | | | | |

I claim:

1. In a method of killing a blowout in a well penetrating a subterranean gas-producing formation by the introduction of fluid into said blowout well through a relief well including a tubing string and casing defining an annulus and penetrating said formation and in fluid communication with said blowout well, the steps comprising:

(a) introducing into said relief well a fluid having a low density which produces a hydrostatic pressure component which is less than the static pressure of said formation, (b) pumping said low density fluid down the annulus of said relief well and into said blowout well at a flow rate to produce a frictional pressure component in said blowout well whereby the sum of said frictional pressure component and said hydrostatic pressure component is greater than the static formation pressure but less than the formation fracturing pressure, (c) introducing into said tubing string a fluid having a density which produces a hydrostatic head in said tubing string which is less than the static formation pressure and maintaining said fluid in said tubing string under conditions such that the pressure differential from the wellhead to the bottom of said tubing string is substantially equal to said hydrostatic head, (d) measuring the wellhead pressure of said tubing string during the injection of said low density fluid down said annulus to monitor the bottomhole pressure in said relief well, (e) continuing the injection of said first fluid as set forth in step (b) down said relief well and into said blowout well to block the flow of gas from said formation into said blowout well, (f) introducing into said relief well a fluid having a sufficiently high density to produce a hydrostatic pressure which is greater than the static formation pressure, and (g) pumping said high density fluid down the annulus of said relief well and into said blowout well at a flow rate which is less than the maximum flow rate of step (b) to produce a frictional pressure loss in said blowout well whereby the sum of said frictional pressure loss and said hydrostatic pressure for said high density fluid is less than the formation fracturing pressure.

2. The method of claim 1 wherein said low density fluid has a density which produces a hydrostatic pressure component which is no greater than two-thirds of the static formation pressure.

3. The method of claim 1 further comprising the step of introducing an additional fluid into said relief well between said low density fluid and said high density fluid, said additional fluid having a density greater than that of said low density fluid but less than that of said high density fluid.

* * * * *

UNITED STATES PATENT AND TRADEMARK OFFICE

CERTIFICATE OF CORRECTION

PATENT NO. : 4,224,989

DATED : September 30, 1980

INVENTOR(S) : Elmo M. Blount

It is certified that error appears in the above-identified patent and that said Letters Patent are hereby corrected as shown below:

Column 3, line 68, "$WHP_rHP_r$" should read -- $WHP_r+HP_r$ --.

Column 7, line 31, in Table I, under "Press Psig",

"3350" should read -- 3550 --.

Column 7, line 60, in Table I, under "Rate BPM",

"1.0+" should read -- 1.0± --.

Signed and Sealed this

*Seventeenth* Day of *March 1981*

[SEAL]

*Attest:*

RENE D. TEGTMEYER

*Attesting Officer*

*Acting Commissioner of Patents and Trademark*